US011225769B2

(12) United States Patent
Coupland

(10) Patent No.: US 11,225,769 B2
(45) Date of Patent: Jan. 18, 2022

(54) SHEAR KEY FORMER APPARATUS AND METHOD(S)

(71) Applicant: CCMJ SYSTEMS LTD, Highland (GB)

(72) Inventor: John Coupland, Strathpeffer (GB)

(73) Assignee: CCMJ SYSTEMS LTD, Highland (GB)

( * ) Notice: Subject to any disclaimer, the term of this patent is extended or adjusted under 35 U.S.C. 154(b) by 0 days.

(21) Appl. No.: 16/969,308

(22) PCT Filed: Jan. 23, 2019

(86) PCT No.: PCT/GB2019/050195

§ 371 (c)(1),
(2) Date: Aug. 12, 2020

(87) PCT Pub. No.: WO2019/158901

PCT Pub. Date: Aug. 22, 2019

(65) Prior Publication Data

US 2021/0047796 A1 Feb. 18, 2021

(30) Foreign Application Priority Data

Feb. 15, 2018 (GB) ..... 1802477

(51) Int. Cl.
*E02D 29/16* (2006.01)

(52) U.S. Cl.
CPC ..... *E02D 29/16* (2013.01); *E02D 2250/0023* (2013.01); *E02D 2300/002* (2013.01); *E02D 2300/0051* (2013.01); *E02D 2600/20* (2013.01)

(58) Field of Classification Search
CPC ..... E02D 29/16; E02D 2600/20; E02D 2250/0023; E02D 5/182; E04B 1/21
(Continued)

(56) References Cited

U.S. PATENT DOCUMENTS

RE25,102 E 12/1961 Buzzell et al.
3,422,627 A 1/1969 Courte
(Continued)

FOREIGN PATENT DOCUMENTS

CN 1143703 A 2/1997
CN 101560767 A 10/2009
(Continued)

OTHER PUBLICATIONS

CCMJ Systems Ltd, UK Patent Application No. GB1706643.2 filed Apr. 26, 2017.

(Continued)

*Primary Examiner* — Sunil Singh
(74) *Attorney, Agent, or Firm* — Moore & Van Allen PLLC; W. Kevin Ransom

(57) ABSTRACT

Provided are apparatus and method(s) for forming one or more shear key(s) between embedded concrete retaining wall(s) and concrete floor slab(s), kits for forming such shear key(s) and underground structures such as embedded concrete wall(s) and slab(s) comprising a shear key. In particular, the invention relates to a shear key former apparatus comprising: a box having an enclosable, internal volume, the box comprising a base and at least one, and preferably four, side wall(s), the side wall(s) terminating in a rim; rearwardly of the rim in two opposing portions of the side wall(s), at least one pair of opposing apertures, each pair of apertures defining an entrance and exit in each respective side wall portion for a rigid member to be accommodated extending across the internal volume between the entrance and the exit; a closure panel configured to be received into the rim to enclose the internal volume.

19 Claims, 5 Drawing Sheets

Figure 2:
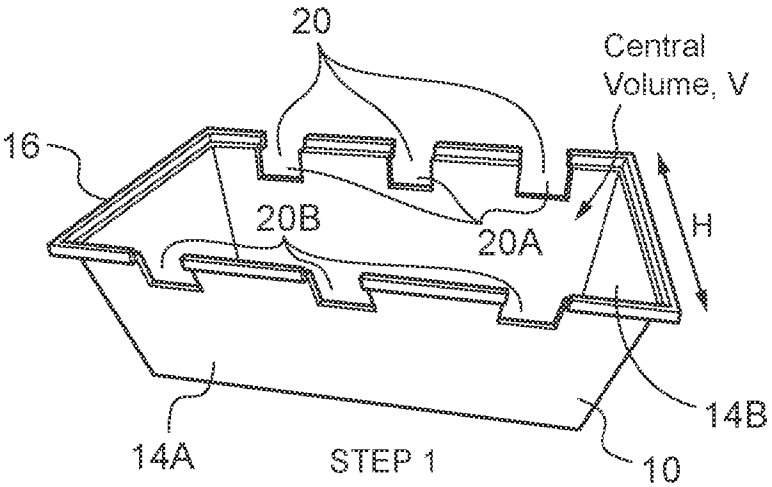

(58) Field of Classification Search
USPC ..... 52/236.5, 236.6, 236.9; 249/13–51
See application file for complete search history.

(56) References Cited

U.S. PATENT DOCUMENTS

| | | | |
|---|---|---|---|
| 3,431,736 | A | 3/1969 | Ueda |
| 3,464,665 | A | 9/1969 | Schoewert |
| 3,759,044 | A | 9/1973 | Caron et al. |
| 3,796,054 | A | 3/1974 | Piccagli |
| 3,798,914 | A | 3/1974 | Irwin |
| 3,938,292 | A | 2/1976 | Kawasaki |
| 4,367,057 | A | 1/1983 | Hughes |
| 4,582,453 | A | 4/1986 | Ressi |
| 4,838,980 | A | 6/1989 | Glaeser et al. |
| 4,930,940 | A | 6/1990 | Charlier |
| 4,990,210 | A | 2/1991 | Glaeser et al. |
| 5,056,242 | A | 10/1991 | Miotti |
| 5,056,959 | A | 10/1991 | Cannac et al. |
| 5,263,798 | A | 11/1993 | Dupeuble et al. |
| 5,548,937 | A | 8/1996 | Shimonohara |
| 6,018,918 | A | 2/2000 | Long |
| 6,052,963 | A | 4/2000 | Lefort et al. |
| 6,164,873 | A | 12/2000 | Miotti et al. |
| 6,276,106 | B1 | 8/2001 | Shotton et al. |
| 8,348,555 | B2 | 1/2013 | Stoetzer et al. |
| 2002/0119013 | A1 | 8/2002 | Shotton |
| 2013/0255180 | A1 | 10/2013 | Daubner et al. |
| 2020/0149240 | A1* | 5/2020 | Jarvi ..... E02D 13/00 |

FOREIGN PATENT DOCUMENTS

| | | | |
|---|---|---|---|
| CN | 101858090 | A | 10/2010 |
| CN | 204753651 | U | 11/2015 |
| CN | 106013086 | A | 10/2016 |
| DE | 3430789 | A1 | 3/1986 |
| DE | 3430790 | A1 | 3/1986 |
| DE | 3503542 | A1 | 10/1986 |
| DE | 3634906 | A1 | 4/1988 |
| DE | 4016388 | A1 | 11/1990 |
| DE | 9001679 | U1 | 7/1991 |
| DE | 4428513 | A | 2/1995 |
| DE | 69201743 | T2 | 7/1995 |
| DE | 19901556 | A1 | 8/2000 |
| DE | 202011051438 | U1 | 11/2011 |
| EP | 0101350 | B1 | 5/1986 |
| EP | 0290303 | A1 | 11/1988 |
| EP | 0333577 | A1 | 9/1989 |
| EP | 0402247 | A1 | 12/1990 |
| EP | 0411682 | A1 | 2/1991 |
| EP | 0509934 | A1 | 10/1992 |
| EP | 0580926 | A1 | 2/1994 |
| EP | 0649716 | A1 | 4/1995 |
| EP | 0833987 | B1 | 1/2001 |
| EP | 0981672 | B1 | 9/2004 |
| EP | 1788157 | A2 | 5/2007 |
| EP | 1983111 | A1 | 10/2008 |
| EP | 1803853 | B1 | 9/2009 |
| EP | 1847650 | B1 | 11/2009 |
| EP | 2647765 | A1 | 10/2013 |
| FR | 2594864 | A1 | 8/1987 |
| FR | 2708946 | A1 | 2/1995 |
| GB | 1137861 | A | 12/1968 |
| GB | 1481186 | A | 7/1977 |
| GB | 1590325 | A | 5/1981 |
| GB | 2315803 | A | 2/1998 |
| GB | 2325262 | A | 11/1998 |
| IT | 1150926 | B | 12/1986 |
| IT | UD930212 | A1 | 4/1995 |
| IT | 1259721 | B | 3/1996 |
| JP | 10245843 | A | 9/1998 |
| JP | 2006070608 | A | 3/2006 |
| RU | 2005110297 | A | 10/2006 |
| WO | 2013007968 | A2 | 1/2013 |

OTHER PUBLICATIONS

CCMJ Systems Ltd, International Patent Application No. PCT/GB2019/050195, International Search Report, dated Apr. 18, 2019.
CCMJ Systems Ltd, International Patent Application No. PCT/GB2019/050195, Written Opinion, dated Apr. 18, 2019.
Casagrande, "The joint forming mill was designed to be used in the construction of diaphragm walls, to replace the conventional stop-end tube for the formation of joints between adjacent panels," Casagrande, Innovation & Technology Nov. 22, 1993, 9 pages.
Coupland, J., "Channel Tunnel Rail Link-Contract 220 Graham Road Deep Vent Shaft", Proceedings: Fifth International Conference on Case Histories in Geotechnical Engineering, New York, NY, Apr. 13-17, 2004; paper 5.47, 4 pages.
Nicholson, "Diaphragm Walls", Downloaded from web Jun. 23, 2011,1 page.
Richards, T.D., Nicholson Construction Company, "Diaphragm Walls", 21st Central PA Geotechnical Conference—Mar. 23-25, 2005. Presented Mar. 23-25, 2006, 18 pages.

* cited by examiner

STEP 2

STEP 3

STEP 4

STEP 5

STEP 6
+
STEP 7

SHEAR KEY FORMER APPARATUS AND METHOD(S)

CROSS-REFERENCE TO RELATED APPLICATIONS

This application is a national stage application (filed under 35 § U.S.C. 371) of PCT/GB2019/050195, filed Jan. 23, 2019 of the same title, which, in turn, claims priority to Great Britain Application No. 1802477.8 filed Feb. 15, 2018; the contents of each of which are hereby incorporated by reference.

FIELD OF THE INVENTION

The invention relates to apparatus and methods for constructing walls and underground concrete structures, such as embedded retaining walls and chambers. In particular, the invention relates to apparatus and method(s) for forming one or more shear key(s) between embedded concrete retaining wall(s) and concrete floor slab(s), kits for forming such shear key(s) and underground structures such as embedded concrete wall(s) and slab(s), e.g. horizontal slabs, comprising a shear key.

BACKGROUND OF THE INVENTION

Concrete embedded retaining walls, such as diaphragm walls, also known as slurry walls in the U.S., have been part of foundation construction for 60 years. Diaphragm walls are used to retain soil and water and to prevent their penetration into an internal chamber. Frequently, a laterally extending slab (typically forming a horizontal floor) is cast against a vertical diaphragm wall to form an underground structure often an entire underground chamber e.g. for an underground car park or other useful space. Forming a suitable joint between the wall and slab is important and such a joint is preferably water tight to reduce and preferably substantially prevent inward water seepage. Such joints (and associated seals where provided) can be perturbed by movement of the slab or wall e.g. due to ground movement and/or uplift (upthrust) from the tendency of hollow structures to 'float' to the surface. It is therefore desirable to prevent or resist vertical shear movement (up and down), and preferably also laterally, between the slab and the wall. This is not a trivial problem to solve at the immense depths used in diaphragm walls.

Forming a joint resistant to movement between diaphragm walls and concrete slabs has always been difficult, time-consuming and expensive. Typically, a laterally extending concrete floor slab (e.g. a generally or substantially horizontal floor slab) is tied into a vertical diaphragm wall (comprising a number of adjoining concrete wall panels) by several horizontal elongate (relatively slender) steel tension connectors (also known as couplers). The tension connectors or couplers are typically made in in two parts, the first part is cast into the diaphragm wall panel. After the face of the diaphragm wall panel is exposed, the first part of the tension connector cast into the panel is located and the second part of the tension connector is connected to the first, typically by means of a threaded coupler. The second part is then cast into the floor slab, connecting the diaphragm wall panel to the slab. For example, multiple steel tension connectors (couplers) spaced around the slab periphery may be used to tie the vertical wall panels into a horizontal slab. These, typically proprietary, tension connectors are made of steel and tend to be very expensive. Examples include those from Ancon, CCL and Lenton.

Providing a concrete shear key extending from the diaphragm wall to the floor slab or from the wall slab into the diaphragm wall is very difficult to achieve, hence the prevalence of steel tension connectors. Indeed, the steel tension connectors are not, strictly speaking, shear keys but by sheer numbers these provide an element of resistance to vertical and horizontal shear movement. Providing, a shear key, particularly a concrete shear key, at the immense depths required (e.g. 30-80 m) in a diaphragm wall construction is problematic in practice. Indeed, providing a concrete shear key located in its entirety at immense depths and which resists vertical shear movement is extremely challenging. Nevertheless, provision and use at depth of concrete shear key(s) resistive to vertical shear movement would be preferable but have not previously been easily achievable at reasonable cost.

The present applicant has described diaphragm walls, apparatus and method(s) of construction, in WO2013/0079868 (COUPLAND I) and an improvement to this in GB1706643.2 (COUPLAND II). These documents are incorporated in their entirety for reference and in particular for their description of diaphragm wall construction.

FR2594864 ROCHMANN and WO2013/007968 COUPLAND describe the use of hollow guideways.

FR2594864 ROCHMANN describes a vertical hollow section 10 with a gasket 16 (FIG. 2), a solid profile 20 e.g. of polyurethane foam (FIG. 3) and an inflatable section 30A (FIG. 4) to prevent entry of concrete. Portion 15 of the reinforcement frame supports the hollow section 10 to avoid tearing when subject to horizontal loads.

WO2013/007968 COUPLAND describes a 3 stage process of firstly casting a vertical guideway tube in a first concrete panel, next in a single pass cutting away a sacrificial portion and using the opened guideway tube as a guide for a trimming the wall, before (or after) this, digging the second panel against the trimmed wall and then casting the concrete to form the second panel.

GB1481186 CALDERWOOD describes oversized holes 6 (behind vertical steel sheets 3 in a trench) but not how these are formed or accessed. The steel sheets 3 provide a platform against which spacer rollers 5 of rebar cage 4 travel.

US2013/0255180 DAUBNER describes a vertical shuttering element and the use of filling material such as sand, granulated material, gravel or gel surrounding a sealing tube in a receiving space.

EP0290303 SCHREIBER describes a process for producing a vertical end joint which uses thin material, releasable magnets or vacuum to facilitate formwork extraction.

Stop-ends, end-stops and shuttering elements and methods are described in U.S. Pat. No. 4,582,453 RESSI, EP0101350 DUPEUBLE, U.S. Pat. No. 5,263,798, DE69201743, EP0509934 all to DUPEUBLE, U.S. Pat. No. 6,052,963 LEFORT, U.S. Pat. No. 3,422,627 COURTE, GB1590325 COMAR REG, GB1481186 CALDERWOOD, US2013/0255180 and EP2647765 both to DAUBNER, GB2315803 GRABNER, DE202011051438U PECA VERBUNDTECHNIK, DE3430790 ZUBLIN, U.S. Pat. No. 6,164,873 MIOTTI, U.S. Pat. No. 3,464,665 SCHOEWERT, EP0290303 SCHREIBER, and DE9001679U BAUER.

Preparing of a first panel end face is described in FR2594864 ROCHMANN, U.S. Pat. No. 4,930,940 and EP0333577 CHARLIER, EP0649716 CASAGRANDE, EP0402247 and U.S. Pat. No. 5,056,959 both to CANNAC, DE19901556 BRUCKNER, ITUD930212 CASA- GRANDE, EP1847650 CASAGRANDE, and WO2013007968 COUPLAND.

Provision of couplings e.g. tension joints between reinforcement cages of adjacent panels, is described in U.S. Pat. No. 4,838,980, DE3430789, U.S. Pat. No. 4,990,210, and DE3503542 all to GLASER, EP1788157 VELTHORST, EP0833987 LEFORT, IT1150926 FENOUX, and U.S. Pat. No. 3,798,914 IRWIN CHILDS.

Provision of water-stops and water bars between adjacent panels is described in GB2325262, U.S. Pat. No. 6,276,106, EP0981672 all to SHOTTON, EP0411682 VERSTRAETEN, EP0580926 MIATELLO, US2002/0119013 SHOTTON, FR2708946 and DE4428513 both to SYDORAK, U.S. Pat. No. 4,367,057 HUGHES, U.S. Pat. No. 3,796,054 PICCAGLI, DE4016388 FISCHER, DE3634906 BEINBRECH, EP1983111 STOTZER, and US25102 BUZZELL.

Use of pre-cast concrete panels is described in U.S. Pat. No. 5,056,242 MIOTTI.

General background to formation of diaphragm walls is found in CN101560767 LIXIN TAN, CN101858090 CUI, IT259721 CASGRANDE, U.S. Pat. No. 3,759,044 CARON, GB1137861 SOLETANCHE, EP1803853 MAURO, RU2005110297 VJACHESLAVOVICH, JP2006070608 MURASAWA, JP10245843 ARIYAMA, CN1143703 AISEN, "FG *Joint Forming Mill Innovation and Technology*" CASAGRANDE—FG Joint Mill Sales Brochure, "*Channel Tunnel Rail Link—Graham Road Deep Vent Shaft*." Proc. 5$^{th}$ International Conference on Geotechnical Engineering 13-17 Apr. 2004 COUPLAND, "*Diaphragm Walls*" by Nicholson (Soletanche Bachy), "*Diaphragm Walls*", Central PA Geotechnical Conference 23-25 Mar. 2006 RICHARDS, U.S. Pat. No. 3,431,736 UEDA, U.S. Pat. No. 5,548,937 SHIMONOHARA, and U.S. Pat. No. 6,018,918 LONG.

The present invention seeks to alleviate one or more of the problems above and presented by the existing art.

SUMMARY OF THE INVENTION

In a first aspect of the invention there is provided a shear key former apparatus (10, 100, 110) comprising: a box (10) having an enclosable, internal volume (V), the box (10) comprising a base (12) and at least one, and preferably four, side wall(s) (14), the side wall(s) (14) terminating in a rim (16); rearwardly of the rim (16), in two opposing portions of the side wall(s) (14), at least one pair of opposing apertures (20), each pair of apertures (20) defining an entrance (20A) and exit (20B) in each respective side wall portion for a rigid member 30A to be accommodated between the entrance (20A) and the exit (20B) extending across the internal volume V; a closure panel (80) configured to be received into the rim to enclose the internal volume (V).

Preferably, rim 16 defines an opening into internal volume V and lies generally or substantially in a first plane.

Preferably, the container is formed from Glass Fiber Reinforced Plastic (GFRP).

Preferably, one or more apertures (20) each comprise(s) a slot (20) extending rearwardly from the rim (16) towards the base (12) in a respective side wall portion.

Preferably, the apertures are sized and shaped to correspond to the rigid member 30A (to be accommodated) such that the rigid member is a close fit in the aperture 20 (the fit being such that any gaps are of greater size e.g. diameter than the intended filler material). Alternatively or in addition one or more closure inserts 60 (preferably made of GFRP panels) are provided to provide such a close fit of the rigid member in each entrance and exit.

It will be understood that the slot(s) could be any suitable shape with a shaped closed end to locate the rigid member 30A in position such as U-shaped, V-shaped or C-shaped. Indeed, these may terminate in a circular, triangular, rectangular or square closed end with an open side to receive the rigid member 30A therein.

Preferably, at least one closure insert (60, 60A, 60B) is provided configured in size and shape to close at least one aperture(s) (20) and to form a close fit, e.g. to substantially prevent outflow of filler material, about a rigid member 30A, when present.

The closure insert(s) 60 may be inside or outside the box 10 and may be lightly glued or screwed or otherwise affixed to the side wall(s). The insert(s) may be any shape (other than around rigid member 30A where it is a close matching fit) but it is preferably planar and made from GFRP or other material of some strength.

Preferably, at least two co-operating closure inserts (60) are provided for each entrance (20A) and/or exit (20B) having co-operating inwardly-facing surfaces e.g. recesses for accommodating a rigid member (30A) therebetween. Preferably these are sized and shaped to close the respective entrance and/or exit (20A, 20B) and to from a close fit about the rigid member, Preferably, the apertures forming the entrance and exit are of similar shape (and size, but slightly bigger) as the rigid member. Preferably the rigid member is of a constant shape, size and cross-section along its extent spanning internal volume V of container 10. Preferably the rigid member is elongate. Preferably, the rigid member is elongate and cylindrical along its length although it may be square or rectangular. It may have surface features and/or surface textures along its length e.g. to enhance flow of concrete around it and fixture of concrete to it. The closure inserts may be glued, screwed or otherwise affixed to the container to seal the slots forming the entrance and exit (e.g. to any out flow of filler) excepting to very small particles and liquids. The filler may be sand, granular material, gravel, gel or the like.

Preferably, the apparatus comprises one or more rigid attachment member(s) (22) extending from the base (12) into the internal volume (V) for rigidly attaching the container to a rigid member (30A) of a rebar cage (92). Preferably, the attachment member(s) (22) comprises a hook (32) at one end and/or a threaded portion at another end.

Preferably, the hook 32 has a free end (tip) so it can pass over and engage with a rigid member 30A when present. Preferably, in use the attachment member extends from a generally central portion of the base to a rigid member 30A spanning the internal volume (V). The attachment member 22 preferably clamps the base 12 to the rigid member 30A and so clamps the box 10 to the rebar cage 92 to form shear key former apparatus 110. Preferably, two or more attachment members, optionally in rows, aligned or staggered, are provided. The number of attachment members preferred will depend on the lateral and vertical extent of box 10 and its final weight when full. Box 10 (and later container 100) should be held in a fixed position on rebar cage 92.

Whilst the closure panel for the box 10 of container 100 attaches the container 10 to rebar cage 92, enhanced by the use of closure inserts 60 about the rigid member 30A, box 10 will typically be very heavy (especially once fully constructed and filled with flowable material e.g. granular material such as pea gravel), so one or more attachment member 22 clamping the base to the one or more rigid member(s) 30A of rebar cage 92 helps to support the weight of the box 10 and its contents 70. The attachment member 22 may have a threaded distal end portion for passing through the base 12 and securing to the rear of base 12 with a nut 24.

Preferably, the enclosable internal volume V is filled with a non-compressible, flowable material (e.g. granular material, gravel, pea gravel, sand or gel). (Preferably the material is of a size (when of granular material) or a composition (when a gel) such that it can be prevented from flowing out from the internal volume V of the box 10 when the container 100 is closed (by the closure panel 80 and optional closure insert(s) 60).

Preferably, the apparatus comprises a closure panel (80) sized and shaped to correspond to the rim (16) for enclosing the internal volume (V). Preferably, the closure panel comprises sacrificial material, for example, ply board, wood, plastic or the like.

Preferably, the closure panel (80) is screwed or glued or nailed or otherwise rigidly affixed to the box (10).

Preferably, the apparatus comprises a reinforcement cage (92) (sometimes referred to herein as a rebar cage), the reinforcement cage (92) comprising at least one rigid member (30A) at or near a front portion of reinforcement cage (92).

Preferably at least one rigid member 30A comprises a front (preferably foremost) vertical member of the reinforcement cage 92 about which (preferably also to the rear of which) the box 10 is located. Preferably the box 10 is constructed abut one or more rigid members 30A within (to a large extent) rebar cage 92, with substantially all or at least a majority of the internal volume V of the container to the rear of the rigid member 30A within cage 92.

Preferably, at least four side walls are provided, optionally comprising two pairs of substantially identical, opposing side walls.

Preferably, one or more flexible members (e.g. ties or bands (90)) are used to surround box (10) and closure panel (80) about elongate rigid member 30A of reinforcement cage 92.

The box 10 is rigidly held to the rebar cage 92 by the attachment member 22 (in the form of threaded hook bar) which takes most of the weight of the container and its contents. The entrance and exit 20A, 20B for each elongate rigid member 30A (typically foremost vertical bar(s) of rebar cage 92) are closed by the closure inserts 60A and 60B retaining filler within box 10 until the desired moment. The closure panel 80 closes the container 10 about the vertical member 30A and the tie band(s) 90 provide supplementary security to secure closure panel 80 in position and prevent this easily coming loose. Typically two or three tie bands are provided per box.

Each box may be anywhere between 250 mm, or more usually between 500 mm, and 5 m in width (across the wall) or even more and between 250 mm, or more usually between 500 mm, and 1000 mm in height up the wall when in final form. There may be 10m to 20 m, of wall (or cage) below the slab depending on soils, but occasionally there may be as little as little as around 1 to 2 m where the diaphragm wall is toed into hard rock. Indeed, there may be more than one slab and whilst it is the lowest slab that typically requires good shear connection to resist uplift, the shear key former apparatus kits and boxes of the invention may be used for other slab-wall connections (e.g. slabs higher up the wall). It will be seen that the boxes 10 have typically one dimension (preferably the horizontal dimension) greater than the orthogonal dimension i.e. these are rectangular. Typically, the boxes 10 are all identical (though this need not be the case, the shape may vary from box to box due to the requirements of the local shear key(s) desired) and are of generally trapezoidal cross-section having at least one, optionally two, preferably four, sloping side walls to facilitate both entrance and exit of filler and also flowing of first bentonite and later concrete into the shaped recess (V) formed by the box 10. The resultant (optionally sloping) side walls of the concrete shear key 99 (See FIG. 5A) provide at least upwardly facing and downwardly facing laterally extending surfaces to resist vertical shear movement. This lateral extent may be as desired typically around 10 to 50 cm, more typically 15 to 30 cm.

Preferably, the apparatus comprises a laterally extending tension connector extending into the internal volume (V). Preferably, the tension connector extends into the internal volume (V) via a through hole in box 10 (preferably in the base 12 of box 10).

In a further aspect there is provided a method of forming a shear key former apparatus as described herein comprising: forming the box (10) having an internal volume (V) terminating in a rim (16) lying generally in a first plane; arranging the box (10) about a front vertical (in use) rigid member (30A) of a rebar cage (92) so a majority of the internal volume (V) (preferably most or substantially all the internal volume) lies within the rebar cage (92); attaching the box (10) to the rebar cage 92 e.g. attaching the box (10) rigidly to the rigid member 30A; adding a non-compressible flowable material (70) to the box (10) when the first plane is generally or substantially horizontal; closing the box (10) with the closure panel (80) to form a closed container (100); rotating the shear key former apparatus (110) comprising reinforcement cage (92) and one or more containers (100) so the first plane is generally or substantially vertical.

Preferably, the method comprises providing one or more closure inserts (60) at one or more aperture(s) (20) sized and/or shaped to co-operate with the rigid member (30A) and aperture(s) (20) to close the aperture(s) (20) to substantially prevent the outflow of the non-compressible flowable material (70).

Preferably, the method comprises providing one or more laterally extending tension connector(s) (34, 36, 38) within internal volume V (e.g. from rebar cage 92, and/or from a rebar cage (not shown) from an adjoining concrete slab or panel).

In a further aspect there is provided a method of forming a shear key resistive to vertical movement between a first and a second concrete structure (e.g. an embedded retaining wall and a slab) comprising: installing the shear key former apparatus (10, 100, 110) as described above, or forming a shear key former using the shear key former apparatus discussed above in a trench filled with bentonite; optionally, allowing bentonite to penetrate the closed container 100; displacing bentonite from the trench by inserting concrete into the trench from the bottom of the trench upwards to forma the first concrete structure (e.g. a wall or wall panel); generally or substantially preventing concrete from entering the container 100; allowing the concrete to set; removing closure panel (8); removing the incompressible material (70) and any bentonite to expose internal volume (V); casting concrete adjacent to the box (10) into the internal volume (V) to form a shear key (99) between the first concrete structure and the newly cast concrete (e.g. a slab).

Where the container is filled with granular material, at least the liquid part of the bentonite will penetrate internal volume V, but where the container is filled with gel, this is less likely to occur.

Preferably, the method comprises casting concrete to cover a laterally extending tension connector (34, 36, 38)

provided within internal volume V. Preferably, the tension connector comprises a first tension connector portion (34) extending from the rebar cage 92 through box (10) into internal volume V. Preferably, the tension connector comprises a second tension connector portion (36, 38) extending from a rebar cage in the second concrete structure into internal volume V. Preferably, the tension connector comprises a first tension connector portion (34) and a second tension connector portion, and these are connected together to form the tension connection.

In a further aspect, the invention provides a kit that preferably comprises:

a box (10) having an enclosable, internal volume (V), the box (10) comprising a base (12) and at least one, and preferably four, side walls (14), the side wall(s) (14) terminating in a rim (16), and rearwardly of the rim (16) in two opposing portions of the side wall(s) (14), at least one pair of opposing apertures (20), each pair of apertures (20) defining an entrance (20A) and exit (20B) in each respective side wall portion for a rigid member 30A to be accommodated extending across the internal volume V between the entrance (20A) and the exit (20B);

and any one or more of:

a closure panel (80) configured to be received into the rim to enclose the internal volume (V); an attachment member (22); flowable incompressible material (70); a flexible band (90), a rebar cage section (92); a tension connector; a first tension connector portion; a second tension connector portion.

Several embodiments of the invention are described and any one or more features of any one or more embodiments may be used in any one or more aspects of the invention as described above.

BRIEF DESCRIPTION OF THE INVENTION

The present invention will now be described, by way of example only, with reference to the following figures. In this document like reference numerals refer to like features and reference numerals are used for the purpose of illustration of example embodiments and are not considered to be limiting.

Figure 1A:
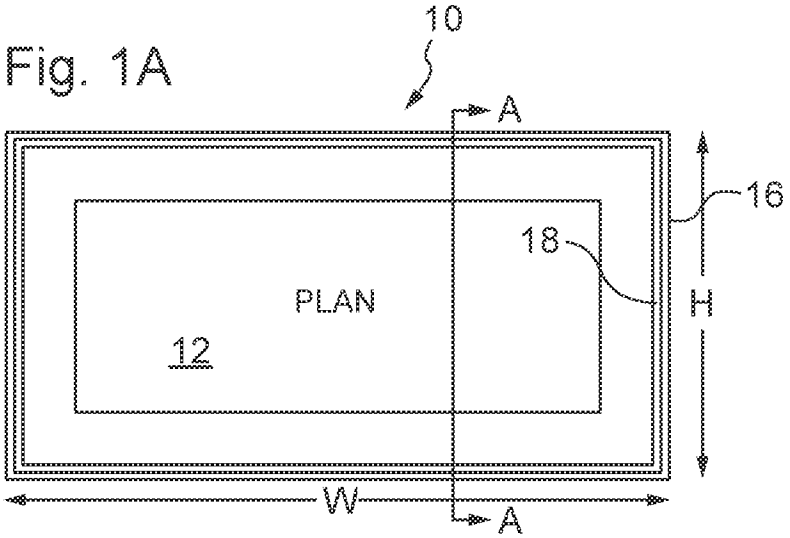
Figure 1B:
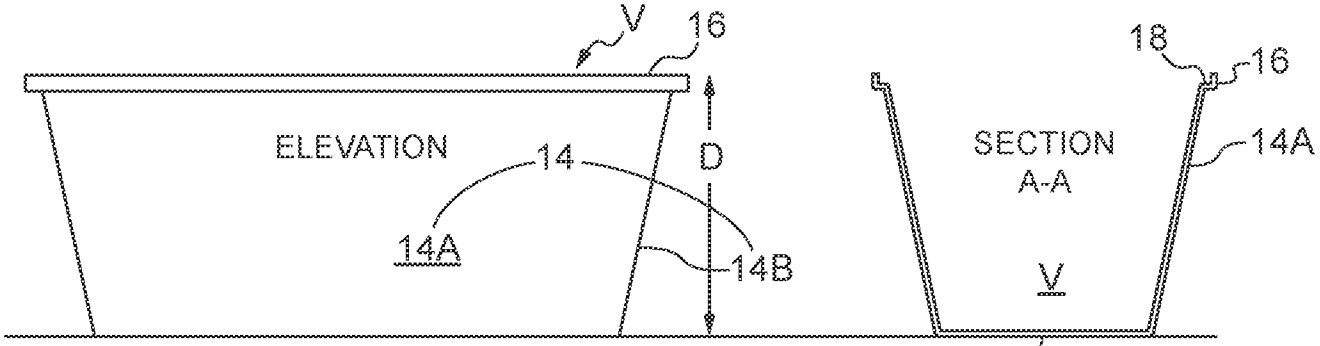

FIGS. 1A, 1B and 10 show, respectively, plan, elevation and sectional (along A-A) views of a box 10 (forming along with a lid or cover a container 100) for use as shuttering in the shear key former apparatus of the invention, prior to corresponding pairs of slots being formed in upstanding side walls of the box.

Figure 4A:
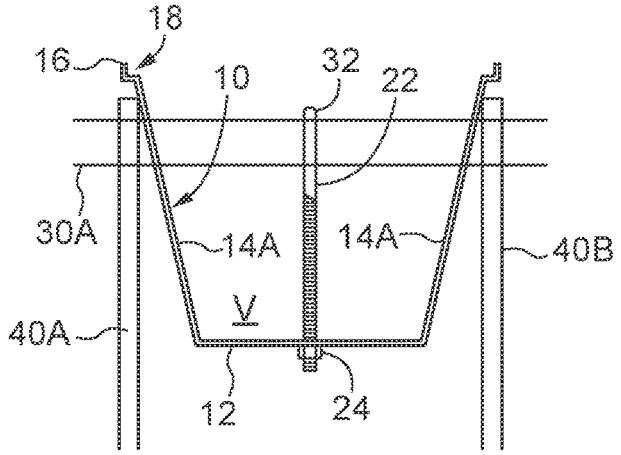
Figure 4B:
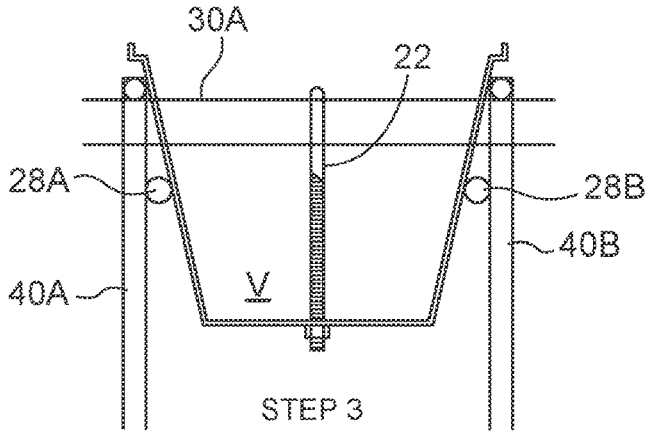
Figure 4C:
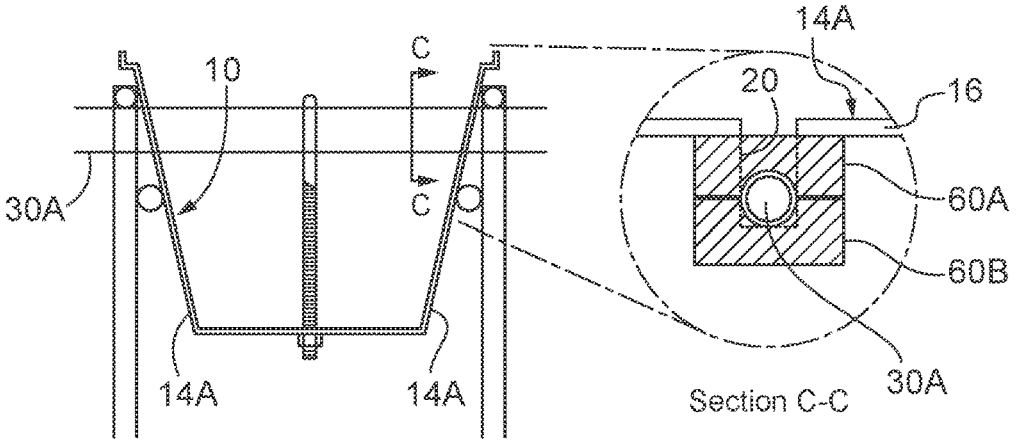
Figure 4D:
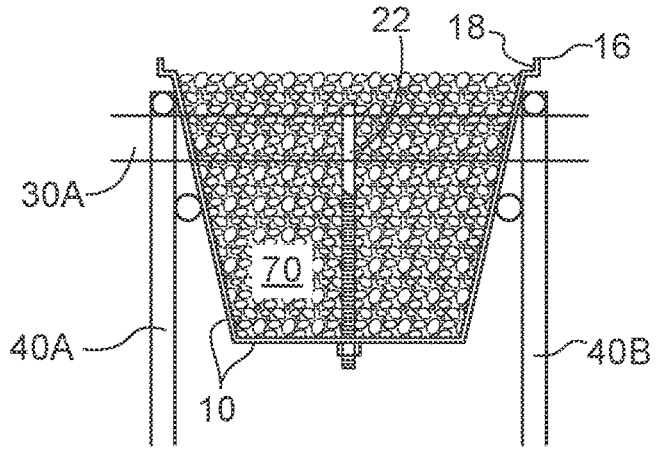
Figure 4E:
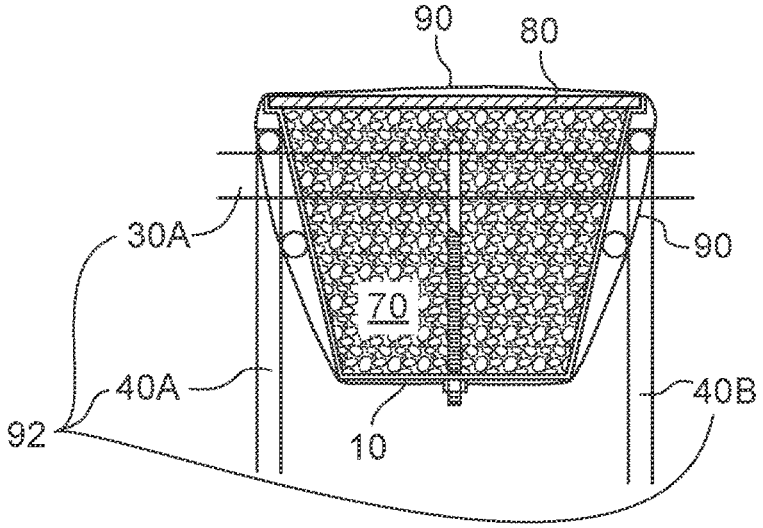
Figures 1, 4F:
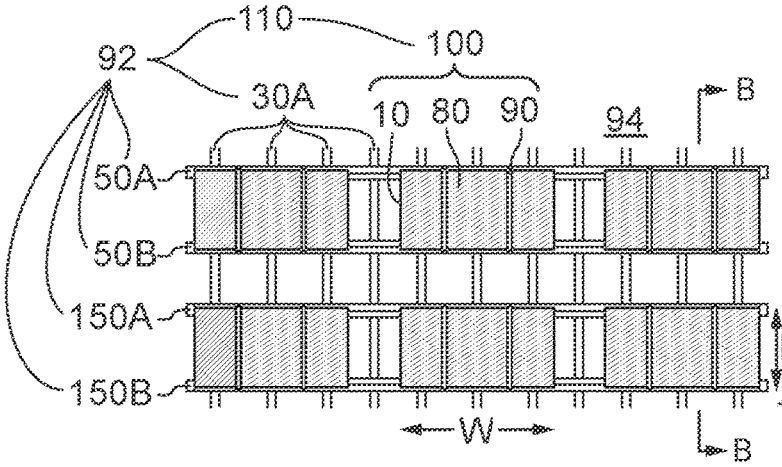
Figures 2, 4F:
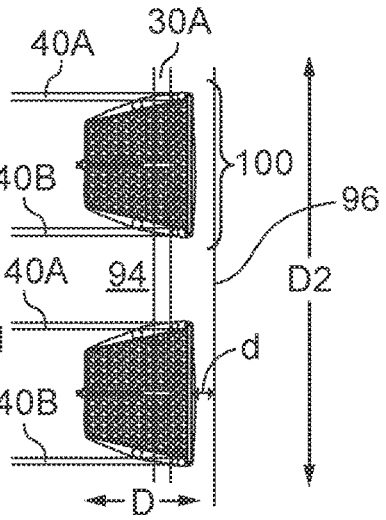

FIG. 2 shows a perspective view of the box of FIG. 1, illustrating three pairs of opposing apertures (here in the form of slots) in upstanding side walls for accommodating three vertical elongate rigid members of a reinforcement cage (not shown).

Figure 3:
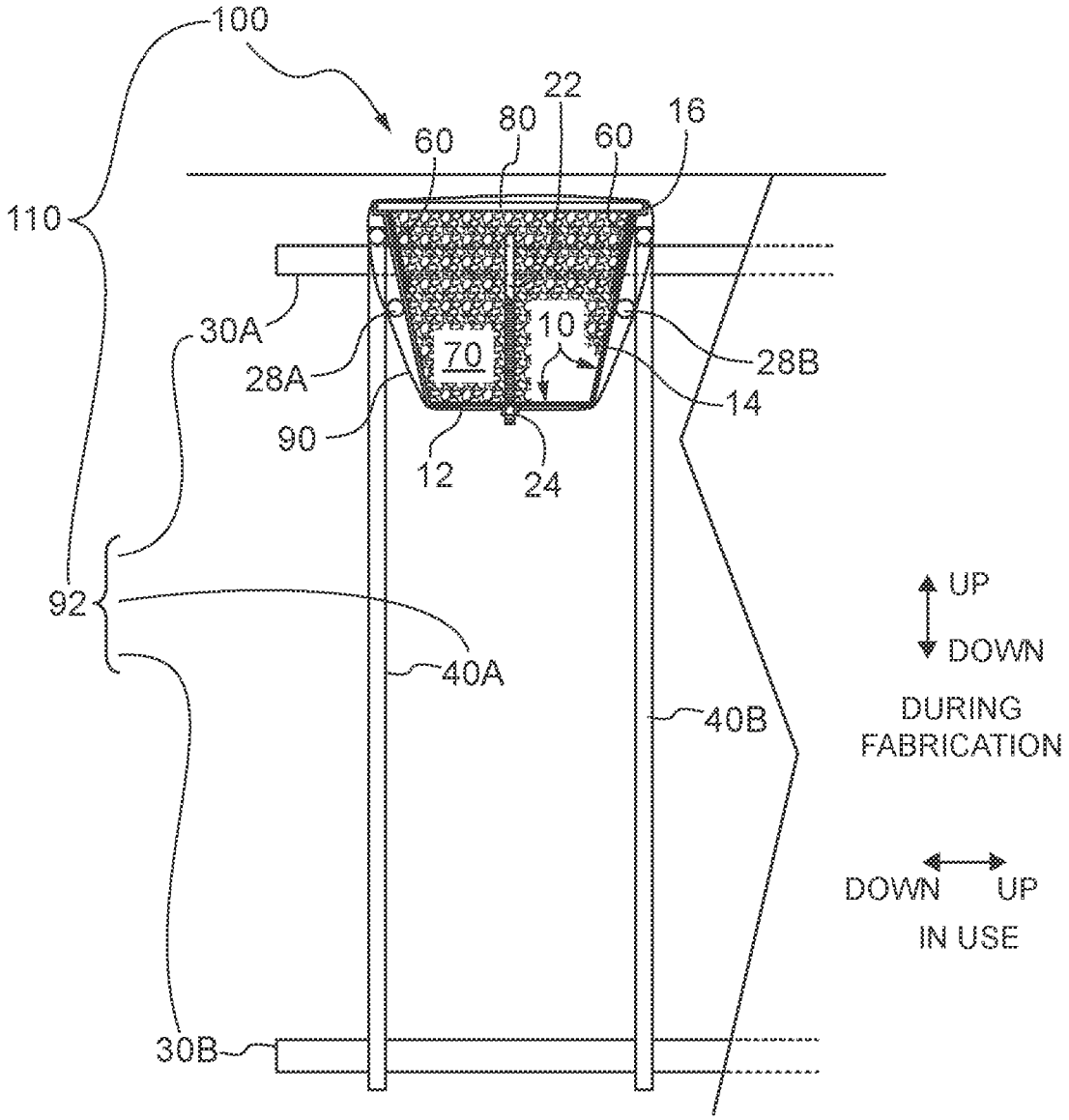

FIG. 3 shows a schematic cross-sectional view of a complete shear key former apparatus, comprising at least one container and a rebar cage, during its fabrication. Here, during fabrication, a vertical elongate rigid member 30A of reinforcement cage 92 and base 12 of box 10/container 100 lie in a horizontal plane.

FIGS. 4A to 4E show sectional elevation views in close up of the shear key former apparatus of FIG. 3 at various stages of its fabrication.

FIG. 4F-1 and FIG. 4F-2 shows respectively front elevation and side cross-sectional elevation views (along B-B) of a shear key former apparatus 110 comprising a rebar cage 92 and multiple (here six) shear key former containers 100 mounted on cage 92.

Figure 5C:
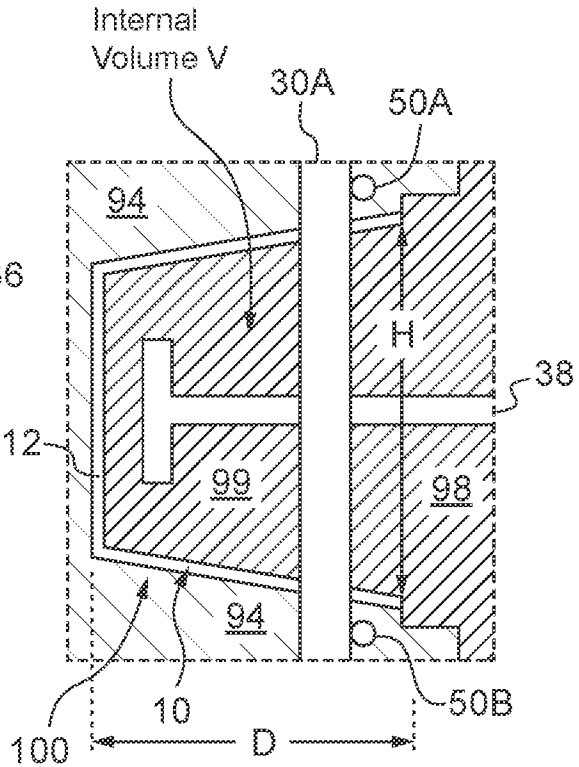
Figure 5B:
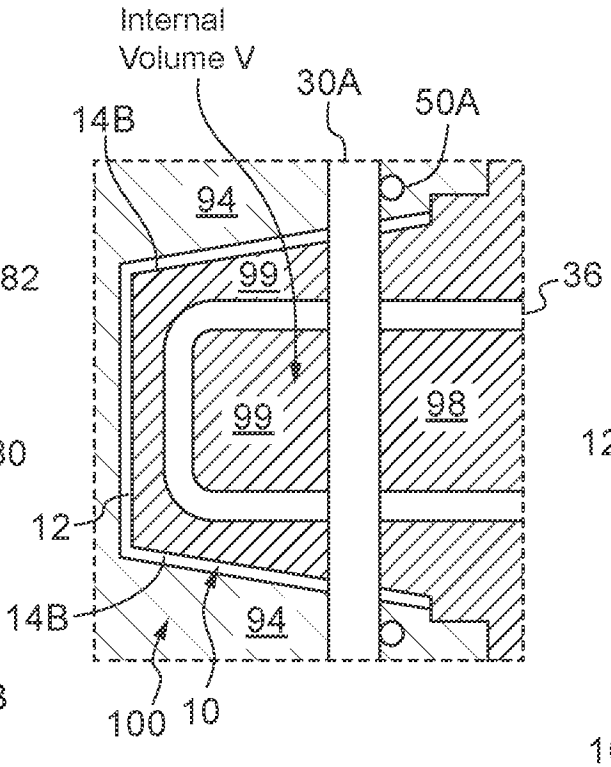
Figure 5A:
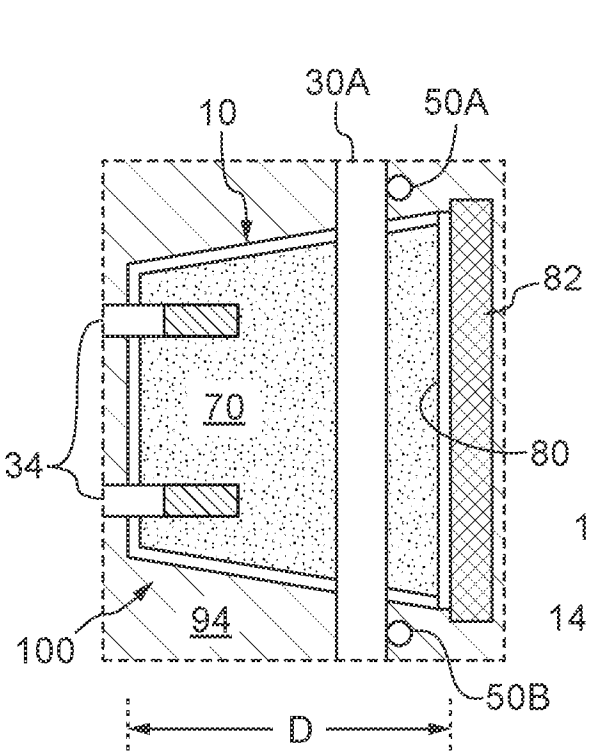

FIGS. 5A, 5B and 5C show, respectively, side cross-sectional elevation view of a shear key former apparatus illustrating a container 100 in a location on vertical member 30A of a rebar cage 92 with various additional optional tension connections for use along with a concrete shear key. FIG. 5A shows container 100 prior to opening whereas FIGS. 5B and 5C show container 100 after opening and formation of a concrete shear key 99 of a concrete slab 98 formed within its internal volume V.

DETAILED DESCRIPTION OF THE INVENTION

In the previous and following descriptions diaphragm walls are referred to for ease of reference, nevertheless it would be understood that various concrete embedded retaining walls such as slurry walls, diaphragm walls, contiguous pile walls, secant pile walls and the like may be constructed using the principles of the invention requiring a joint between such a wall and a concrete slab (typically a horizontal concrete slab). The term diaphragm walls and concrete slab is to be understood to include such other walls and slabs unless the context requires otherwise. Concrete is referred to throughout for simplicity but it will be well understood that the invention applies to any flowable, hardenable material.

Furthermore, the previous and following descriptions refer to concrete panels that are typically planar, and rectangular in cross-section, having two generally planar, substantially parallel 'side' faces of greater width and two generally planar, substantially parallel 'end' faces of narrower width. However, it is to be understood the invention may be used with other shaped panels such as 'panels' of circular or other (e.g. square, hexagonal) cross-sections such as piles. Whilst the apparatus and methods of the invention are particularly described herein in relation to 'side' faces (also known as 'front' faces) of generally rectangular concrete panels, it is to be understood that the apparatus and methods of the invention can be used in relation to 'end' faces (also known as 'end' walls) of a rectangular panel or indeed of another shaped 'panel' such as a circular, square, hexagonal 'panel(s)' and 'pile(s)'.

Vertical diaphragm wall panels used to form a diaphragm wall are described in more detail in WO2013/09868 COUPLAND I.

The term 'slab' is used herein to indicate a laterally extending concrete panel, typically cast as a floor or roof with a generally or substantially horizontal uppermost and/or lowermost face.

It will be understood by those skilled in the art that any dimensions and any directions, such as vertical or horizontal, referred to within this application are within expected construction tolerances and limits for building diaphragm walls and underground embedded structures and these terms should be understood and construed with this in mind.

Throughout this description, components are described and identified with reference to their orientation and location during use (not during fabrication). For example, vertical elongate rigid members 30A are foremost (at the front, facing the open space) of the reinforcement (rebar) cage and are vertical in use. These are shown lying horizontally during fabrication in FIGS. 3 and 4A to 4E with the rebar cage 92 on its side to allow placement and filling of box 10. These terms of orientation and location are not limiting unless the context dictates otherwise.

Figure 1C:
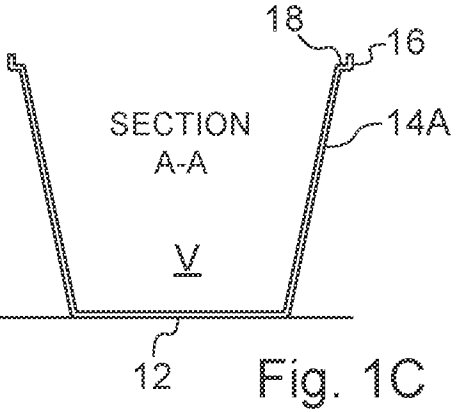

FIGS. 1A, 1B and 1C show a generally rectangular box 10 preferably made from Glass Fiber Reinforced Plastic (GFRP). Other materials may be used, e.g. steel or plastic, but GFRP is particularly advantageous for concrete joints as it has similar shear strength to concrete and does not corrode. Other sacrificial materials are typically used for formwork as, typically, formwork is easily removable. At immense depths below ground, this is less easy.

Box 10 is generally cuboid here comprising a rectangular base 12 and four side walls 14 upstanding from base 12. Box 10 here comprises two pairs of opposing side walls 14A and 14B inclined (at a small angle to 90°) with respect to base 12 to form a rectangular rim of greater peripheral dimensions to corresponding dimensions of base 12. Side walls 14A are wider than side walls 14B. In use, side walls 14A face upwardly and downwardly. Preferably all four side walls are inclined to base 12 by a small angle (away from orthogonal), preferably the same small angle, but one or more side walls e.g. one or both side walls 14B, or one or both side walls 14A may be orthogonal to base 12.

Box 10 may be formed (e.g. cast from GFRP) as a single component or may be made from separate components (e.g. base, walls etc.) glued, nailed or otherwise affixed together. Other shapes might be considered such as square, or even circular or triangular, as opposed to a rectangular base 12 and rectangular rim 16 (and corresponding) upstanding wall(s) but such a shape providing two side walls 14A that each face upwardly and downwardly is particularly useful as a shear key resistive to vertical movement. The rim 16 defines an opening to the internal volume (V) of box 10.

Here, side walls 14 (14A, 14B) slope outwardly at preferably 5-25°, more preferably 5-15°, from the base 12 to facilitate access into the internal volume V of box 10 and in particular ingress and egress of flowable materials. Box 10 has a depth (D) and maximum width (H) and a maximum length (W) during fabrication which form, respectively, a shear key 99 of depth (D) of maximum height (H) and of maximum width (N) in the final concrete structure (ignoring the thickness of the side walls 14). In this example, and preferably, the width W of the shear key (and of walls 14A) is greater than the height of the shear key (i.e. greater than the width H of side walls 14B). Box 10 is therefore more specifically in this example a generally trapezoidal shape having orthogonal cross-sections of trapezoidal shape formed by two opposing pairs of outwardly and upwardly sloping side walls 14, each preferably sloping at the same angle to base 12.

Upwardly extending side walls 14 terminate in a shaped rim 16 which is preferably substantially rectangular in plan view. Shaped rim 16 is provided with a peripheral recess 18 for receiving a closure panel therein, as will be described later. Recess 18 extends laterally outwards (it is here L-shaped in cross-section) from the top of side walls 14 so that side walls 14 encompass the internal volume V allowing this to be filled to the brim e.g. to the level of recess 18.

Box 10 is provided with apertures here in the form of cut outs or slots 20 extending rearwardly into side walls 14 from rim 16 towards base 12. Slots 20 are here shown to be rectangular but these might be circular or square or other shapes. Slots 20 are provided in opposing pairs, one in each opposing side wall, preferably in the wider side walls 14A of box 10. Each pair of slots 20 comprises an entrance 20A and an exit 20B into which a vertical member of a reinforcement cage (not shown) may be receivable so that it spans across the internal volume V. Here, slots 20 form square-shaped crenulations in rim 16 and side walls 14A. Whilst apertures such as through-bores may be used, the use of slots facilitates placement of box 10 behind vertical rebar members after a rebar cage has been formed. Naturally the size of box 10 should be small enough to pass between members of the rebar cage to fit behind a 'front face' of the cage.

FIG. 3 shows a shear key former apparatus 110 comprising a container 100 and a reinforcement (rebar) cage 92. Container 100 here comprises box 10, attachment member 22, closure inserts 60, granular material (here pea gravel 70), closure panel 80 and flexible bands 90. Container 100 is rigidly clamped to one or more elongate rigid member(s) 30A by one or more hooked attachment member(s) 22 (there may be one or more than one per rigid member 30A).

Here vertical rebar member(s) (first elongate rigid member(s) 30A) is/are in a horizontal orientation. Preferably, an elongate rigid member 30A is a foremost component of the rebar cage 92 in use forming part of a 'front face' of rebar cage 92. Similarly a second elongate rigid member 30B is preferably a rearmost vertical rebar member and forms part of a 'rear face' of rebar cage 92 in use. Here second elongate rigid member 30B is shown in a horizontal orientation at the end of fabrication. Rebar cage 92 may have other members (e.g. vertical and horizontal members) but these are not shown for clarity. The structure and construction of rebar cages 92 is adapted to suit the particular construction situation where these are to be employed and these and the use of multiple rigid members to form the cage are very well known to those skilled in the art.

Here, rebar cage 92 comprises several rearwardly extending, horizontal members 40A, 40B and 50A, 50B (orthogonal to 40A and 40B and not shown in FIG. 3) to provide overall structural rigidity and strength to rebar cage 92. In FIG. 3, horizontal bars 40A and 40B are shown in a vertical position during fabrication. In this orientation the base 12 of box 10 is lowermost and side walls 14 extend upwardly and outwardly away from base 12 to facilitate filling. One or more closure inserts 60, typically small panel shaped members of GFRP, plastic or plywood or the like, are affixed (e.g. welded, glued, nailed etc.) to side walls 14A around slots 20 and rebar member(s) 30A to close any gaps between slots 20, rebar member(s) 30A and side walls 14. Box 10 is filled with flowable material, preferably flowable granular material such as sand, gravel or pea gravel 70 e.g. of 5-10 mm diameter, preferably filled in it entirety. Box 10 is itself closed by closure panel 80 which rests in recess 18 of rim 16. Typically closure panel 80 is formed from sacrificial material and is preferably screwed, or welded, glued, nailed or otherwise affixed to recess 18 in rim 16.

In use, a rebar cage 92 and, in particular, vertical members 30A, 30B may be formed in sections of cage of several metres in length e.g. 10 to 30 m (in use height) ready to be joined together with other sections of several metres in length to form a continuous reinforcement cage in a deep, bentonite-filled trench for a panel of a diaphragm wall. Such trenches may extend from a few metres or tens of metres to several tens of metres such as 60-80 m in depth. Pressures at these immense depths are tremendous so bentonite slurry or similar is used to prevent the trench collapsing.

In one aspect, the invention provides a substantially rigid container 100 (preferably of GFRP) filled (to the brim) with substantially incompressible flowable material e.g. granular material such as pea gravel 70 although gel may be used. This incompressible flowable material is held within it during formation of the shear key. Where granular material is used, this allows liquid (e.g. from bentonite slurry) to penetrate the container, further providing resisting compression of the box and its contents during descent and retaining this incompressibility even at great depth. Nevertheless, in at least one aspect, the invention substantially prevents the displacement of bentonite by rising concrete from the container as explained in more detail below.

Rear wedges 28A, 28B (A-upper in use, B-lower in use) are formed from solid circular bars and are inserted in between horizontal upper and lower bars 40A, 40B and 50A, 50B (not shown) to support further the weight of container 10 and its contents and aid resisting movement of the container relative to cage 92 during descent into a bentonite-filled trench and during displacement of the bentonite by concrete.

Indeed, container 100 and/or shear key former apparatus 110 comprising filled container 100 and rebar cage section 92 can be constructed off-site (or indeed on-site) but before lowering of the completed rebar cage structure 110 into the trench. Thus, rebar cage 92 may be provided with multiple containers 100 per section of rebar cage to suit the requirements of the particular design of diaphragm wall and slab to which it is to be connected.

Various steps in the construction of the wall will now be described in detail with reference to the Figures and especially FIG. 4A to FIGS. 4F-1 and 4F-2.

In brief, a first step (step 1) a box 10 is formed (see FIGS. 1A to 10 and 2) and inserted within rebar cage 92 predominantly behind vertical member 30A. Secondly, in step 2, see FIG. 4A, a box 10 is attached to vertical elongate rigid member 30A by a hook-shaped attachment member 22. Attachment member 22 has a threaded distal end which passes through base 12, and a hooked proximal end which passes around member 30A. As a nut 24 is tightened on the threaded distal end, the hook draws the box 10 towards and clamps it to member 30A. Other forms and numbers of attachment member may be used, but it is preferred that box 10 is clamped tightly to one or more elongate rigid members 30A. In optional step 3 (see FIG. 4B) upper and lower rearward second wedge members 28A and 28B respectively, are provided supporting container 10 on rearwardly extending horizontal bars 40A and 40B. In optional step 4 (see FIG. 4C) one or more co-operating closure inserts 60A (and 60B) shaped to correspond to slots 20 and elongate rigid member 30A are welded on walls 14A surrounding vertical elongate rigid member 30A. In step 5 (see FIG. 4D) container 10 is filled with pea gravel 70. In step 6 (see FIG. 4E) box 10 is closed with a front closure panel 80 to form a container 100. In optional step 7 (see FIG. 4E) one or more one or more surrounding tie(s) 90 are positioned around the now closed box 10.

In more detail now, firstly, a container 10 such as that shown in FIG. 2 is formed from GFRP by well-known methods as would be understood by those skilled in the art. Slots 20 may be cut out or drilled out or may be formed in container 10 during laying out of the fibers. Indeed, container 10, when produced in GFRP, is formed over a mould of the desired shape (e.g. generally or substantially trapezoidal of rectangular cross-section) upon which glass fibers are laid in layers covered over using plastic which is sprayed on. The shape of the mould determines the shape and size of internal volume V of box 10 (and so of complete container 100). The mould (not shown) may comprise one or more upstanding corresponding pairs of spigots, e.g. one or more, preferably an even number corresponding to slots 20 so that the desired location of slots 20 are kept free of GFRP and so slots 20 are formed. In this way, the mould provides a well-defined smooth surface of predetermined shape that provides internal volume V of container 10 with a well-defined smooth surface of predetermined size and shape, optionally with readymade slots 20.

Secondly, box 10 is placed against and to the rear of one or more vertical rebar member(s) 30A forming the front face of rebar cage 92. The vertical rebar member(s) 30A form(s) rigid member(s) 30A spanning volume (V) within box 10 between opposing slots 20A, 20B which form respectively an entrance and an exit for rigid member(s) 30A. Preferably the rebar member(s) 30A are elongate (and relatively slender in the manner of rebar members), but these may not be. Box 10 is not entirely to the rear of vertical member(s) 30A but a substantial portion of the volume encompassed by box 10 does lie to the rear of these. Typically box 10 is brought up to the rear of rebar member(s) 30A and slotted onto these members via slots 20 (20A, 20B). Box 10 is sized and shaped to fit neatly within two horizontal members 40A, 40B (shown vertically in FIG. 4A during construction), the relative spacing of which is configured to closely fit around box 10. These provide additional support to the box during use, supporting the weight of the filled container 100

An attachment member 22, e.g. having a hook 32 at a front end and threaded at the other end (not labelled), is inserted threaded end first into a through hole in base 12 of container 10 preferably perpendicular to base 12. Indeed, one, or two, or three or more attachment members 22 may be used for each container. A nut tightened on the threaded end behind the base draws hook(s) 32 towards vertical rebar member(s) 30A clamping the base 12 and so container 10 rigidly to vertical rebar member(s) 30A.

In FIG. 4A, sides 14A, 14B are vertical forming a cavity or internal volume V into which flowable, preferably granular, material such as pea gravel e.g. of 5-10 mm diameter or the like can be placed under gravity. Rim 16 and recess 18 extend slightly beyond the front of rebar cage 92 and in particular preferably beyond the front of elongate rigid member(s) 30A so that elongate rigid member(s) are encompassed within it. To achieve this, slots 20A, 20B which form, respectively, entrance and exits for elongate rigid member(s) 30A are deeper than the thickness (here diameter as member 30A is circular in cross-section) of elongate rigid member 30A, so that it is covered in pea gravel (and will later be covered in concrete). This leaves gaps at least to the front of elongate rigid member 30A, from member 30A up through the slot towards rim 16.

In FIG. 4B optionally, at least one, and preferably upper and lower, rear wedges may be provided by horizontal elongate rigid rods 28A, 28B (sometimes referred to herein as wedge members) to support the weight of box 10 securely in between upper and lower horizontal members 40A, when it is rotated ready for use.

A pair of rear wedge members 28A, 28B in the form of elongate rigid steel rods fit securely between horizontal members 40A, 40B of the cage and the outermost surfaces of side walls 14A of container 10. These help take the weight of filled container 10 when it is rotated ready for use.

Next, as shown in FIG. 4C, one or more closure inserts 60A and 60B of predetermined size and shape, are glued, welded or otherwise affixed to side walls 14A and are shaped to accommodate vertical rebar member 30A in a snug, but preferably not water tight, fit and to substantially cover and close off slot 20 in side wall 14A. Whilst preferably not water tight, closure inserts 60A, 60B substantially close the entrance(s) 20A and exit(s) 20B provided by slot(s) 20 to accommodate vertical rebar members 30A. These (and cover 80) substantially prevent the contents of container 10 from falling out during rotation or descent into a trench, particularly where the content is granular and the granules have sufficient diameter greater (on average) than any remaining gaps.

Turning to FIG. 4D, next, pea gravel 70 is inserted into the upright container 10. At this stage, leakage from slots 20 would be small given the orientation of box 10 but, closure of slots 20A, 20B nevertheless allows container 10 to be filled to the brim with pea gravel 70. By filling box 10 virtually entirely full with preferably granular material such as pea gravel, the container is highly resistant to crushing. Furthermore, because filled container 100 is not watertight, the inflow of the liquid component of bentonite slurry is not prevented, allowing container(s) 100 fill with liquid during descent (into the spaces between the granules), displacing any remaining air and reducing the effect of 'up thrust' and further resisting compression at depth.

As shown in FIG. 4E, next box 10 is closed by a closure panel 80 which is screwed, nailed, or glued or otherwise affixed to rim 16 to form a filled container 100. Optionally, an additional nylon band 90, or preferably multiple spaced nylon bands 90, are fixed tightly around box 10 and cover 80 to provide added security against closure panel 80 becoming disengaged because of the weight of the container's contents. Closure panel 80 preferably is screwed to pre-threaded holes in an inner wall of recess 18. By providing a laterally extending recess 18 in rim 16 which lies beyond the internal volume V of container 10, the internal volume of container 10 can be filled entirely without leaving any potentially compressible gaps. Preferably, pea gravel 70 is settled (e.g. by vibration) into container 10 to reduce the spaces between this granular material.

Multiple containers 100 are preferably affixed to a single rebar section. These filled containers 100 may be spaced horizontally by one or two metres and vertically by one or two metres across the front section of the rebar cage 92. Preferably, filled containers 100 are generally or substantially evenly spread over a lower portion of a lowermost section of rebar cage 92 against which a floor slab is to be cast. Alternatively these are provided on a section of rebar cage against which a slab is to be cast perhaps part way up a diaphragm wall.

Once constructed, each section of rebar cage 92 in combination with one or more filled containers 100 form a shear key former apparatus 110 ready for rotation to a vertical orientation and lowering into a trench filled with bentonite. As can be seen from FIGS. 4F-1 and 4F-2, rebar cage 92 has, in addition to horizontal members 40A, 40B, 140A, 140B extending rearwardly from a front face of rebar cage 92 (exemplified by foremost rebar members 30A), horizontal rebar members 50A, 50B, 150A, 150B extending across, parallel to and generally in the same plane as front most vertical rebar members 30A.

FIGS. 4F-1 and 4F-2 show the shear key former apparatus 110 formed from a lower section rebar cage 92 and here multiple filled containers 100 in position in a constructed diaphragm wall 94 formed of concrete. Front face 96 of diaphragm wall 94 is shown. A small depth of concrete 'd' is shown to the front of closure panels 80.

In practice, once a shear key former apparatus comprising the rebar cage and filled containers is formed, it is rotated and lowered into a trench filled with bentonite. The filled containers made of GFRP and filled with pea gravel will resist compression under the pressure of bentonite. Indeed, at least liquid will seep into containers 100 further assisting in resisting compression of the containers. If containers 110 were entirely sealed this would present a sealed cavity with air spaces which ultimately would resist descent into a bentonite-filled trench and indeed might tend to 'float'. Thus, seepage of bentonite into container 100 is expected and, indeed, preferred. Upon full descent to the required position at which the shear key to a horizontal concrete slab is to be formed, the descent is stopped. Next bentonite is displaced by concrete from the bottom of the trench upwards. Unlike bentonite, concrete is less fluid due to the larger particle size and it hardens relatively quickly. Thus, containers 100, now filled with pea gravel and bentonite, resist the upward flow of concrete and indeed resist seepage of concrete into containers 10 and, indeed, displacement of bentonite out of containers 100. Thus, the internal volume V of container 100 remains 'full' with removable material (here pea gravel and bentonite). Once the concrete has hardened into a diaphragm wall 94 with a front face 96, a small depth of concrete 'd' remains in front of closure panels 80.

Next, once the vertical diaphragm wall is completed, the space next to it is dug out. Typically the diaphragm wall forms an enclosure, and the enclosure is excavated to reveal the innermost surface 96 of the diaphragm wall panels forming an underground chamber.

Next, the thin layer of concrete is removed (e.g. with a hammer if it is a few cm thick, or with a power tool) allowing access to closure panel 80 and the contents of container 100. The closure panel 80 is typically of sacrificial material such as plastic or plywood. It can be removed along with the small depth 'd' of concrete (or separately after the concrete) e.g. by a hammer and crow bar. If the pea gravel and bentonite do not flow out of the container 100 which, as can be seen from FIG. 4F-2, has a (now) downwardly sloping lower side wall, it may be washed out using a high pressure water hose. A concrete slab of desired shape and depth can be cast, preferably after any debris, e.g. pea gravel, cover remnants and bentonite, has been removed from the adjoining enclosure.

When the adjacent concrete slab is cast, concrete flows into the now empty internal volume V of the GFRP containers 10 forming, here, a trapezoidal, shear key 99 (see FIG. 5B). The concrete slab shown here has depth 'D2' such that two rows of horizontally spaced shear keys are provided between the slab and the diaphragm wall. Here, the containers 100 (and resulting shear keys not shown) are aligned vertically one above the other, but these may be staggered or overlapping. Furthermore, the shear keys are of the same shape and as the internal volume V of box 10, here a generally trapezoidal shape of rectangular cross-section with upwardly and downwardly facing laterally extending side walls resistant to vertical shear movement.

The wider opening of box 10 provided by one or more sloping side walls 14A and/or 14B facilitates flow of concrete into their internal volume V reducing risk of air gaps and forming a robust shear key shape. The shape of shear key 99 is shown in FIGS. 5B and 5C in cross-section in which a horizontal slab 98 has been formed comprising one or more shear key(s) 99 extending laterally into internal volume V within GFRP boxes 10. Preferably, the shear key is wider (W) in a horizontal direction than it is high (H) in a vertical direction (W>H) to resist vertical forces in particular. The dimensions, width OM, height (H) and depth (D) as well as the shapes, location and number of shear keys can be varied with local construction requirements. GFRP boxes 10 thus remain in position and form part of the final structure.

Referring now to FIGS. 5A, 5B and 5C, various forms of tension connectors are shown which may be used to supplement shear key 99. In FIG. 5A, rebar cage 92 (not shown) is provided with one or more (here two) threaded tension connection members 34 extending into volume V. The base 12 of container 10 has through holes to accommodate one or more such threaded tension connector first members 34 in a close fit. First members 34 are (like rigid members 30A) embedded in pea gravel 70. Also shown in FIG. 5A is an optional void former 82 formed of sacrificial material such as foam, polystyrene etc, which is shaped and sized to sit immediately in front of closure panel 80 preventing concrete adhering directly to closure panel 80 and facilitating removal of closure panel 80. Such a void former 82 may be used in any aspect and embodiment of the invention. Once closure panel 80 (and optional void former 82) have been removed and pea gravel 70 and any bentonite also removed, a tension connection can be made to a further reinforcement cage intended to be cast into horizontal slab (not shown). Corresponding tension connection second members may be cast within the slab 98 and connected to the threaded end(s) of tension connector first members 34. Following formation of the tension connection(s), horizontal slab 98 can be poured forming combined shear key 99 and tension connection(s) between the wall and slab 98.

It can also be seen in FIG. 5A, that vertical elongate rigid member 30A of rebar cage 92 is here entirely embedded within diaphragm wall 94 and is also entirely embedded in horizontal slab 98 within shear key 99. In other words, vertical elongate rigid member 30A extends from wall 94 through shear key 98 and back into wall 94. This also provides some tension as well as a shear connection between wall 94 and slab 98.

In FIG. 5B, a U-shaped steel tension connector 36 is provided cast into slab 98 which forms part of the slab reinforcement. Tension connector 36 resists extraction from volume V but does not form a direct tension connection within wall 94. U-shaped steel tension connector 36, which may be formed around or to one side of vertical rigid rebar member 30A, also provides some tension and shear connection. Similarly, in FIG. 5C, a T-shaped tension connector may be formed, again providing resistance to the extraction of slab 98 from shear key 99 within diaphragm wall 94.

In one aspect, the invention provides a GFRP shear key former set into a rebar cage of reinforcement to provide a shear key within the rebar cage forming a shaped recess within the rebar cage into which a protruding section of a second concrete panel can be poured to form a shear key. Currently proposed is a U-shaped GFRP box (with four side walls and a base) that may be laid horizontally—it may form an elongate trough—and that can be sealed about one or more members of rebar cage but protrudes inwardly within the rebar cage. A lid and optional sealing plates (closure inserts 60A, 60B) made from GFRP may be provided to form an enclosed container mostly of GFRP. The seal around the rebar member(s) into the trough just has to be good enough to keep out all but the very, very fine concrete silt. Optionally, but preferably, a filler such as gravel, pebbles or even gel or void-former foam is provided within internal volume V so that this supports the GFRP shear key former during pouring of the first concrete panel. A standard foam void-former may be placed on top of the cover lid as protection. The protective covering of void-former and lid are removed and a slab or even a second concrete panel can be poured which will then form a shaped shear key between the first panel and the later poured slab or panel. Optionally, tension rebar-type members may be provided through the base of the shaped box for later use in providing a tension connection between the first concrete panel and later poured slab (or panel).

Thus a GFRP shear key former container is provided to the rear of the outermost face of the rebar cage and a plywood or other sacrificial closure panel is provided on the container on the front face of the rebar cage. It is beneficial to use GFRP as steel would be expensive and subject to corrosion and plastic may introduce a weak point but these may be considered. GFRP has a higher compressive strength than concrete and, depending on the direction of the fibers, a tensile strength which can approach that of steel, thus providing a strong point (rather than a weak point) within the embedded concrete structure. This arrangement, when used to form a shear key joint, answers many of the structural problems used within diaphragm wall construction when trying to tie a horizontal slab into a diaphragm wall or, indeed, a second panel into a first panel within a diaphragm wall. How to provide recesses behind the front face of a rebar cage in a diaphragm wall below ground is not trivial. The present invention proposes the creation of multiple concrete horizontally extending shear keys protruding from a horizontal slab into one or more or all vertical panel(s). Furthermore, these horizontal shear keys may be wider in a horizontal direction than they are tall, thus providing greater shear key strength in the upwards downwards direction to resist relative motion in this direction.

Various components may include:

a recessed preferably GFRP, preferably trapezoidal, hollow box (preferably with two orthogonal trapezoidal cross-sections) with apertures, slots or recesses about its periphery for accommodating one or more reinforcement cage bars, preferably vertical bars, an attachment mechanism such as a hook bar with thread for passing around a vertical bar, a closure panel of sacrificial material such as plywood or plastic, various screws for self-tapping into holes provided, granular material e.g. sand, gravel such as pea gravel of around 10 mm (⅜ inch) or more typically 5-10 mm diameter, closure insert(s) for closing any significant holes around the encompassed rebar members, tension connector(s), and/or tension connector portion(s).

The process for achieving this may include one or more of the following steps:

forming a GFRP container of preferably trapezoidal shape of optionally one dimension greater than the other orthogonal dimension, arranging the container internally within a rebar cage substantially or generally to the rear of a front vertical (in use) member of the rebar cage such that the longer dimension of the container is generally or substantially perpendicular to the vertical (in use) member, optionally wedging the container in position using horizontal (in use) wedge members, attaching the hollow container to the vertical (in use) rebar member (when the container and rebar member are both in a horizontal position)

optionally, closing any remaining gaps around the vertical (in use) rebar member(s) by one or more closure inserts, optionally lightly welding these closure inserts to the container, adding pea gravel to the container (when the base is lowermost—like a trough), closing the container by adding a closure panel and fixing this to the container e.g. using holes and self-trapping screws and/or a nylon band, rotating the combined rebar cage and container(s) structure from the horizontal to the vertical, installing the rebar cage in a trench filled with bentonite, allowing bentonite to penetrate the closed container via remaining gaps, displacing bentonite from the trench by injecting concrete from the base up, generally or substantially preventing concrete from entering the container by providing granular material e.g. pea gravel within the container, and closure inserts to generally or substantially seal the holes around the vertical rebar members to concrete ingress, allowing the concrete to set, removing the closure panel, allowing the granular material and bentonite to fall out and/or actively washing the granular material and bentonite out of the hollow container, and/or casting a horizontal slab adjacent to the recess formed by the hollow GFRP container to form a shear key joint between a vertical diaphragm wall and a horizontal slab.

Whilst the invention is particularly applicable to a concrete shear key resistive to relative vertical movement between a vertical concrete diaphragm wall (or wall panel and an adjacent laterally extending e.g. horizontal slab), it can also be used between adjacent end walls of concrete wall panels to resist relative vertical movement between these. Indeed, such a vertical motion resistant shear key can be useful in combination with a concrete shear key resistive to horizontal (side to side) shear as described in WO2013/007968 COUPLAND between adjacent wall panels. Typically, one or preferably two, vertical shear resistant concrete shear keys as described herein may be provided to one or both sides of a horizontal shear resistant shear key described in COUPLAND.

Further embodiments will be apparent to those skilled in the art herein, all such alternative embodiments are intended to be covered by the claims. This is particularly the case where structural components may be of a different shape or size or construction but perform the purpose described herein or which may differ in shape and/or size and/or design elements but which, nevertheless, fulfil the purpose of the respective components described herein.

The invention claimed is:

1. A shear key former apparatus comprising:

a box having an enclosable, internal volume, wherein the box comprises:

a base;

at least one side wall, the at least one side wall extending from the base and terminating in a rim;

at least one pair of opposing apertures located between the rim and the base, in two opposing portions of the at least one side wall, wherein the at least one pair of opposing apertures define an entrance and an exit in each respective side wall portion and are configured to receive a rigid member, where the rigid member extends between the at least one pair of opposing apertures across the enclosable, internal volume of the box; and a closure panel configured to be received into the rim to enclose the enclosable, internal volume to form a closed container.

2. An apparatus according to claim 1, wherein the box is formed from Glass Fiber Reinforced Plastic.

3. An apparatus according to claim 1, wherein one or more of the apertures of the at least one pair of opposing apertures comprise a slot extending from the rim in a direction towards the base in a respective side wall portion.

4. Apparatus according to claim 1, further comprising at least one closure insert configured in size and shape to close at least one aperture of the at least one pair of opposing apertures to thereby form a close fit about the rigid member, when present.

5. An apparatus according to claim 1, further comprising one or more rigid attachment members attached to and extending from the base into the enclosable, internal volume and comprising a hook configured for rigidly attaching the container to the rigid member.

6. Apparatus according to claim 1, wherein the enclosable, internal volume is filled with a non-compressible, flowable material.

7. Apparatus according to claim 1, wherein the closure panel is sized and shaped to correspond to the rim for enclosing the enclosable, internal volume.

8. Apparatus according to claim 1 further comprising a reinforcement cage, the reinforcement cage comprising the rigid member at or near a front portion of the reinforcement cage.

9. Apparatus according to claim 8 further comprising one or more flexible members configured to surround the box and the closure panel about the rigid member of the reinforcement cage.

10. Apparatus according to claim 1 further comprising a laterally extending tension connector extending into the enclosable, internal volume of the box.

11. A method of forming a shear key using a shear key former apparatus, said shear key former apparatus comprising: a box having an enclosable, internal volume, wherein the box comprises: a base; at least one side wall, the at least one side wall extending from the base and terminating in a rim; at least one pair of opposing apertures located between the rim and the base, in two opposing portions of the at least one side wall, wherein the at least one pair of opposing apertures define an entrance and an exit in each respective side wall portion and are configured to receive a rigid member, where the rigid member extends between the at least one pair of opposing apertures across the enclosable, internal volume; and a closure panel configured to be received into the rim to enclose the enclosable, internal volume to form a closed container, wherein said method comprises:

forming the box having the enclosable, internal volume terminating in the rim lying generally in a first plane;

arranging the box about a front vertical rigid member of a reinforcement cage so a majority of the enclosable, internal volume lies within the reinforcement cage;

attaching the box to the reinforcement cage;

adding a non-compressible flowable material to the box when the first plane is substantially horizontal;

closing the box with the closure panel to form the closed container; and rotating the shear key former apparatus comprising the reinforcement cage and the closed container so the first plane is substantially vertical.

12. A method according to claim 11 further comprising:

providing one or more laterally extending tension connectors within the enclosable, internal volume of the box.

13. A method of forming a shear key according to claim 11, said shear key being resistive to vertical movement between a first and a second concrete structure, said method comprising:

Installing the shear key former apparatus in a trench filled with bentonite;

optionally, allowing the bentonite to penetrate the closed container;

displacing the bentonite from the trench by inserting concrete into the trench from a bottom of the trench upwards to form the first concrete structure;

substantially preventing the concrete from entering the container;

allowing the concrete to set;

removing the closure panel;

removing the non-compressible material and any of the bentonite to expose the enclosable, internal volume of the box;

casting further concrete adjacent to the box into the enclosable, internal volume to form a shear key between the first concrete structure and further concrete forming the second concrete structure.

14. A method according to claim 13 further comprising:

providing a laterally extending tension connector within the enclosable, internal volume of the box and, wherein the step of casting further concrete comprises casting the further concrete to cover the laterally extending tension connector within the enclosable, internal volume.

15. A method according to claim 14 wherein the laterally extending tension connector comprises a first tension connector portion extending from the reinforcement cage in the first concrete structure, through the box, and into the enclosable, internal volume.

16. A method according to claim 15 in which the laterally extending tension connector comprises a second tension connector portion extending from a further reinforcement cage in the second concrete structure into the enclosable, internal volume of the box.

17. A method according to claim 16, wherein the tension connector comprises the first tension connector portion and the second tension connector portion, which are connected together to form the tension connection.

18. A kit comprising at least two shear key former apparatuses, wherein each comprises a box comprising an enclosable, internal volume, wherein the box comprises:

a base;

at least one side wall, the at least one side wall extending from the base and terminating in a rim;

at least one pair of opposing apertures located between the rim and the base, in two opposing portions of the at least one side wall, wherein the at least one pair of opposing apertures define an entrance and an exit in each respective side wall portion and are configured to receive a rigid member, where the rigid member extends between the at least one pair of opposing apertures across the enclosable, internal volume; and a closure panel configured to be received into the rim to enclose the enclosable, internal volume to form a closed container.

19. A kit according to claim 18 further comprising at least one of:

the closure panel configured to be received into the rim to enclose the enclosable, internal volume;

an attachment member;

flowable incompressible material;

a flexible band;

a rebar cage section;

a tension connector;

a first tension connector portion; and/or a second tension connector portion.

* * * * *